US006585243B1

(12) United States Patent
Li

(10) Patent No.: US 6,585,243 B1
(45) Date of Patent: Jul. 1, 2003

(54) QUICK-ACTION BAR CLAMP

(76) Inventor: Tsung-Hsiang Li, No. 9, Lane 510, Sec. 2, Janghe Rd., Hemei Chen, Changhua Hsien (TW)

( * ) Notice: Subject to any disclaimer, the term of this patent is extended or adjusted under 35 U.S.C. 154(b) by 0 days.

(21) Appl. No.: 10/260,660

(22) Filed: Sep. 30, 2002

(51) Int. Cl.[7] ..... B25B 5/02
(52) U.S. Cl. ..... 269/6; 269/3; 269/171.5
(58) Field of Search ..... 269/6, 3, 166–171.5, 269/194, 203, 197–199, 228; 81/487

(56) References Cited

U.S. PATENT DOCUMENTS 5,217,213 A * 6/1993 Lii ..... 269/6
5,454,551 A * 10/1995 Hobday ..... 269/6
6,412,767 B1 * 7/2002 Beckmann et al. ..... 269/166
6,450,489 B1 * 9/2002 Wang ..... 269/6
6,474,632 B1 * 11/2002 Liou ..... 269/6

* cited by examiner

*Primary Examiner*—Lee D. Wilson
(74) *Attorney, Agent, or Firm*—Alan Kamrath Rider Bennett, LLP

(57) ABSTRACT

A quick-action bar clamp comprises a body, a slide bar, clamp mechanism, a drive assembly and a pawl assembly. The slide bar has a series of teeth along one edge and is movably mounted in the body. The clamp mechanism includes a stationary jaw mounted on the body and a movable jaw opposing the stationary jaw connected to one end of the slide bar. The drive assembly includes a trigger, a drive lever and a spring. A push pin mounted in the trigger presses the drive lever and moves the slide bar when the trigger is squeezed. The pawl assembly includes a pawl, a release tab, a biasing element and a plastic tag. The pawl engages the teeth on the slide bar to positively hold the slide bar in position when the trigger is released.

8 Claims, 8 Drawing Sheets

QUICK-ACTION BAR CLAMP

BACKGROUND OF THE INVENTION

1. Field of the Invention

The present invention relates to a bar clamp and more particularly to a quick-action bar clamp with a non-round slide bar with multiple teeth and a pawl assembly to engage with teeth. A movable jaw can be rapidly advanced and released easily when a workpiece is clamped between a movable and a stationary jaw.

2. Description of Related Art

A bar clamp operated with one hand is used to clamp two articles together and is more convenient than a bar clamp that requires two hands to operate. With reference to FIG. 8, a conventional bar clamp comprises a slide bar (70), a stationary jaw (71), a movable jaw (72), a body (73), a drive assembly and a brake (76). The movable jaw (72) opposes the stationary jaw (71) and is mounted at one end of the slide bar (70) that is movably mounted through the body (73). The slide bar (70) has a top edge and a bottom edge.

The body (73) has a top, a bottom, a front edge, a cavity (731), a transverse hole (732) and a handle (74). The stationary jaw (71) is formed on the top of the body (73). The cavity (731) is defined in the body (73) and the slide bar (70) passes through the cavity (731). The transverse hole (732) is formed in the front edge of the body above the slide bar (70). The handle (74) is formed at the bottom of the body (73).

The drive assembly comprises a trigger (75), a drive lever (751) and a spring (752). The trigger (75) has a top, a bottom, a front edge and rear edge and is pivotally mounted in the body (73) corresponding to the handle (74) so the top of the trigger (75) is in the cavity (731). The drive lever (751) has a front surface, a rear surface and a hole (not numbered) through which the slide bar (70) passes, is suspended on the slide bar (70) and abuts the rear edge of the trigger (75). The hole of drive lever (751) has a top edge and a bottom edge. The spring (752) has two ends and is mounted around the slide bar (70) in the cavity (731). One end of the spring (752) abuts the drive lever (751), and the other end abuts an interior surface of the cavity (731).

The brake (76) has a central hole and is pivotally attached to the transverse hole (732) in the front edge of the body (73). The slide bar (70) passes through the central hole in the brake (76). The central hole in the brake (76) has a top edge and a bottom edge. A compression spring (762) is mounted between the brake (76) and the front edge of the body (73) so the brake (76) is pushed to an inclined standby position.

To move the movable jaw (72) toward the stationary jaw (71), the trigger (75) is squeezed toward the handle (74), and the trigger (75) pivots the drive lever (751). The hole in the drive lever (751) is inclined so the top and bottom edge of the hole grip the top and bottom edges of the slide bar (70) and push the slide bar (70) back. As the drive lever (751) pushes the slide bar (70) back, the movable jaw (72) moves toward the stationary jaw (71). The slide bar (70) is kept from moving forward by the brake (76) because the central hole in the brake (76) grips the top edge and bottom edge of the slide bar (70) when the trigger (75) is released. The compression spring (762) keeps the brake (76) in position to grip the slide bar (70) to prevent the slide bar (70) from moving forward.

However, the conventional bar clamp has some shortcomings that include:

1. Bad engagement effect:

Because the drive lever (751) and the brake (76) must be inclined to grip the slide bar (70) and the top and bottom edges of the slide bar (70) are flat and smooth, the drive lever (751) and the brake (76) occasionally slip. When the movable jaw (72) and the stationary jaw (71) clamp a workpiece with a lot of force, the force acting on the movable jaw (72) will cause the movable jaw (72) to move away from the stationary jaw (71) unless the brake (76) engages the top and bottom edges of the slide bar (70).

2. Disengaging the brake (76) from the slide bar (70) is not easy:

Because the brake (76) applies a transverse force to the edge of the slide bar (70), the pressure of the brake (76) acting on the slide bar (70) is unstable. When the brake (76) does securely hold the slide bar (70) in position, disengaging the brake (76) from the slide bar (70) is often difficult.

3. The slide bar (70) is not durable:

The drive lever (751) and the brake (76) engaging the edge of the slide bar (70) and will damage the edge. After extensive use, the slide bar (70) will not hold the moveable jaw (72) in all positions and will have to be replaced.

To overcome the shortcomings, the present invention provides an improved bar clamp to obviate or mitigate the aforementioned problems.

SUMMARY OF THE INVENTION

A quick-action bar clamp in accordance with the present invention includes a non-round slide bar with a series teeth is movable mounted in a body. Clamp means includes a stationary jaw mounted at a top of the body and a movable opposing the stationary jaw is connected to one end of the slide bar. A drive assembly includes a handle formed at a bottom of the body and a trigger opposing the handle pivotally mounted in the body to advance the slide bar by squeezing the trigger toward the handle. A pawl assembly includes a pawl engages with the teeth of the slide bar to prevent a reverse motion of the slide bar when the trigger is released.

Accordingly, an objective of the invention is to provide an improved quick-action bar clamp that provides a nice clamping purpose.

Another objective of the invention is to provide a quick-action bar clamp to release the movable jaw easily when a workpiece is clamped.

Still another objective of the invention is to provide a quick-action bar clamp wherein the bar clamp is one-hand operable.

Other objectives, advantages and novel features of the invention will become more apparent from the following detailed description when taken in conjunction with the accompanying drawings.

DETAILED DESCRIPTION OF PREFERRED EMBODIMENT

Figure 1:
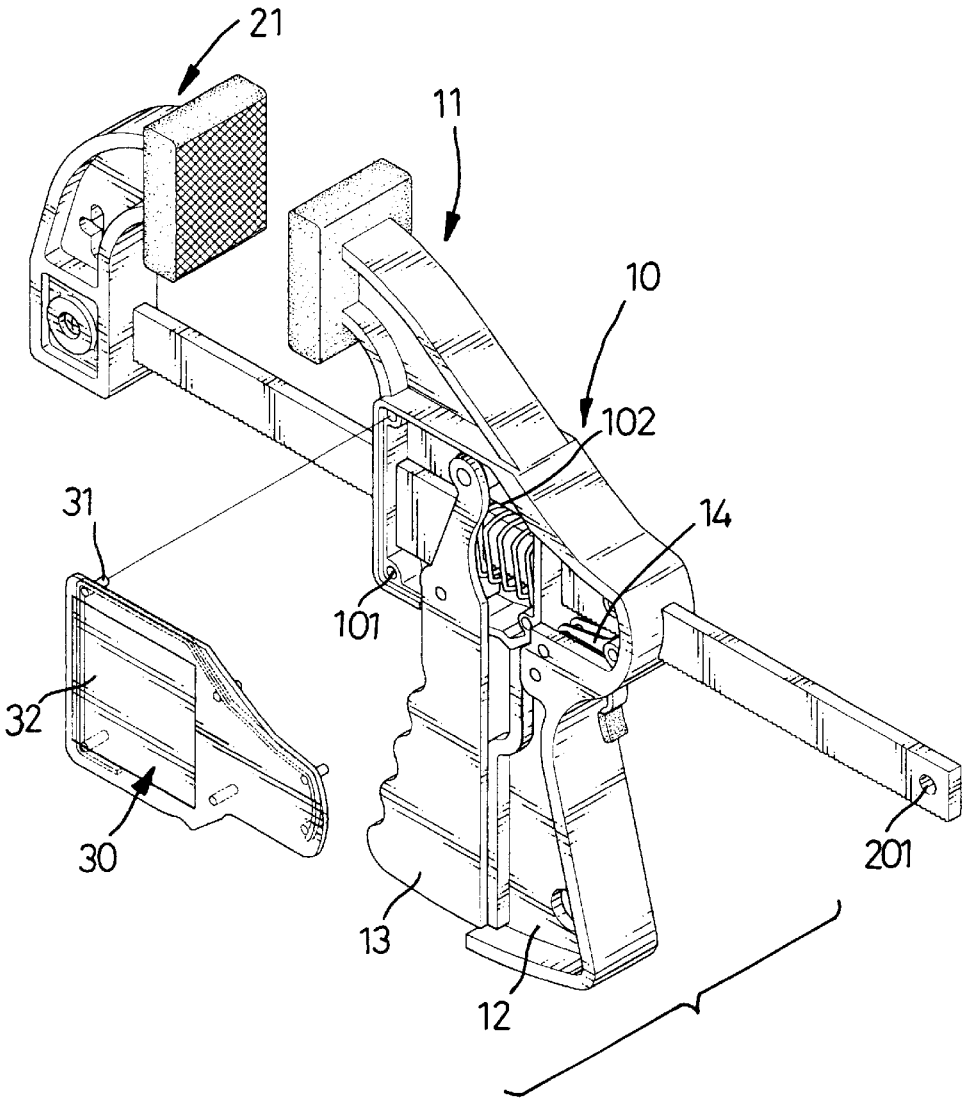
FIG. 1 is a perspective view showing the quick-action bar clamp in accordance with the present invention.
Figure 2:
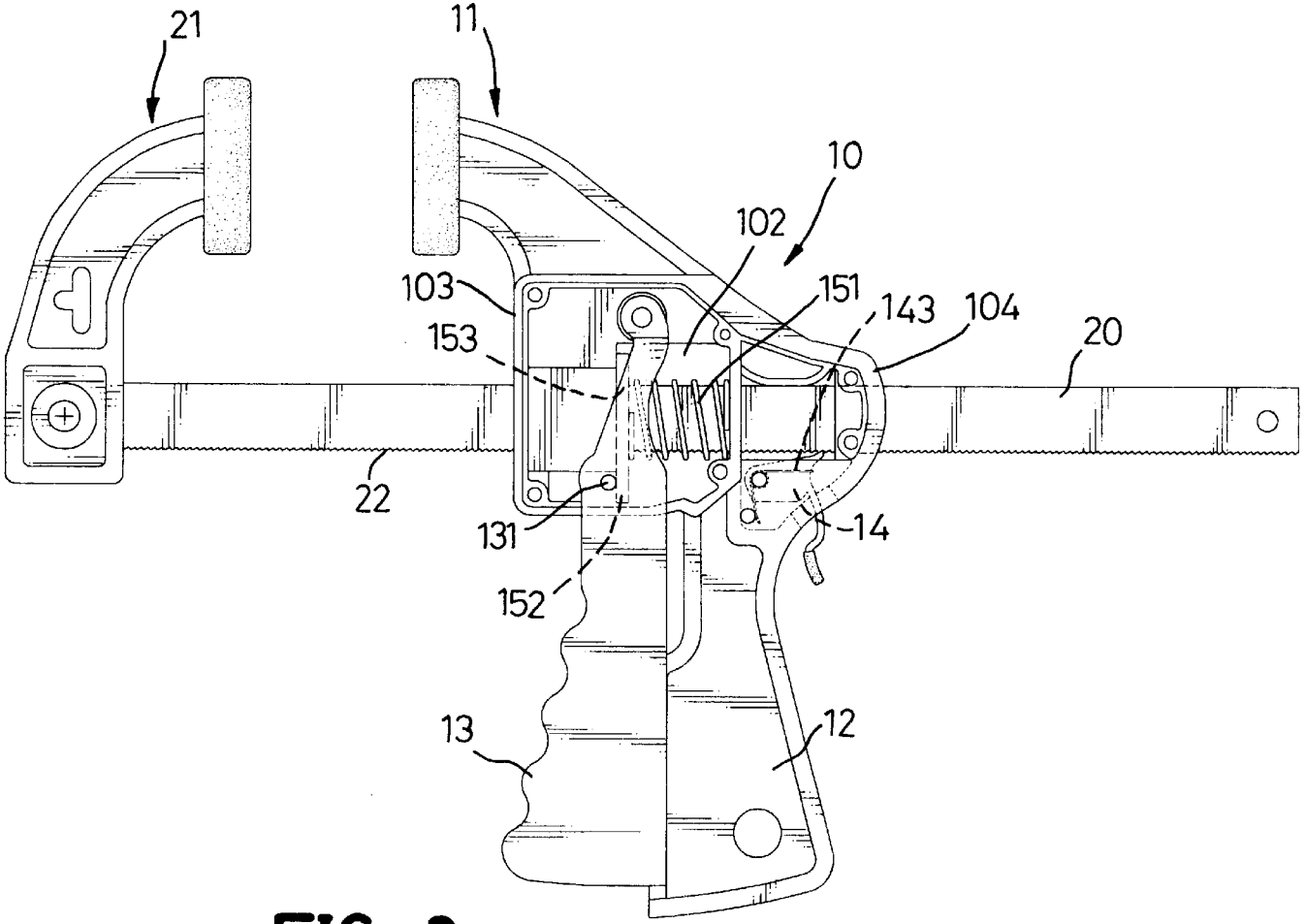
FIG. 2 is a plan view showing the quick-action bar clamp in FIG. 1.

With reference to FIGS. 1 and 2, a quick-action bar clamp in accordance with present invention comprises a body (10), a slide bar (20), clamp means, a drive assembly and a pawl assembly (14).

The body (10) has a top (not numbered), a bottom (not numbered), two sides, a front edge (103), a rear edge (104), a handle (12), a central transverse opening (102), a rear transverse opening (not numbered) and two covers (30). The handle (12) is formed at the bottom of the body (10) and extends down from the body (10). The central transverse opening (102) has a front edge, a rear edge, two sides and several joint holes (101). Joint holes (101) are defined around each side of the central transverse opening (102) respectively. Each cover (30) has stubs (31) corresponding to the joint holes (101) in one side of the central transverse opening (102) respectively and is attached to the side of the body (10) to cover the central transverse opening (102) and the rear transverse opening (102). One of the covers (30) has a recess (32) that is used to paste a ticket or a label.

The slide bar (20) has a front end, a rear end, a top edge, a bottom edge, a series of teeth (22) and two screw holes (201). The slide bar (20) is not round, passes through the central transverse opening (102) and the rear transverse opening and is slidably mounted in the body (10). The front end of the slide bar (20) extends out of the body (10) through the front edge (103). The rear end extends out of the body (10) through the rear edge (104). A series of teeth (22) are formed on the bottom edge of the slide bar (20), and the screw holes (201) are defined respectively near opposite ends of the slide bar (20).

The clamp means is implemented with a stationary jaw (11) and a movable jaw (21). The stationary jaw (11) is formed on the top of the body (10). The movable jaw (21) opposing the stationary jaw (11) is connected to the front end of the slide bar (20) so the slide bar (20) can draw the movable jaw (21) toward the stationary jaw (11) to clamp a workpiece between the two jaws (11, 21). The movable jaw (21) can be detached from the front end of the slide bar (20) and replaced or attached to the rear end of the slide bar (20) by means of the screw hole (201) to convert the clamp to a spreader. When the clamp is configured as a spreader, the slide bar (20) drives the movable jaw (21) away from the stationary jaw (11) to push two workpieces apart by the two jaws (11, 21).

The drive assembly includes a trigger (13), a drive lever (152) and a spring (151). The trigger (13) corresponds to the handle (12) and is pivotally mounted in the body (10). The drive lever (152) has a central hole (153) and is suspended on the slide bar (20) in the central transverse opening (102). The slide bar (20) passes through the central hole (153). A push pin (131) adapted to push against the drive lever (152) is mounted in the trigger (13). The spring (151) is mounted around the slide bar (20) in the central transverse opening (102) between the drive lever (152) and the rear edge of the central transverse opening (102). When the push pin (131) in the trigger (13) is no pressing the drive lever (152), the spring (151) presses the drive lever (152) against the front edge of the central transverse opening (102).

Figure 3:
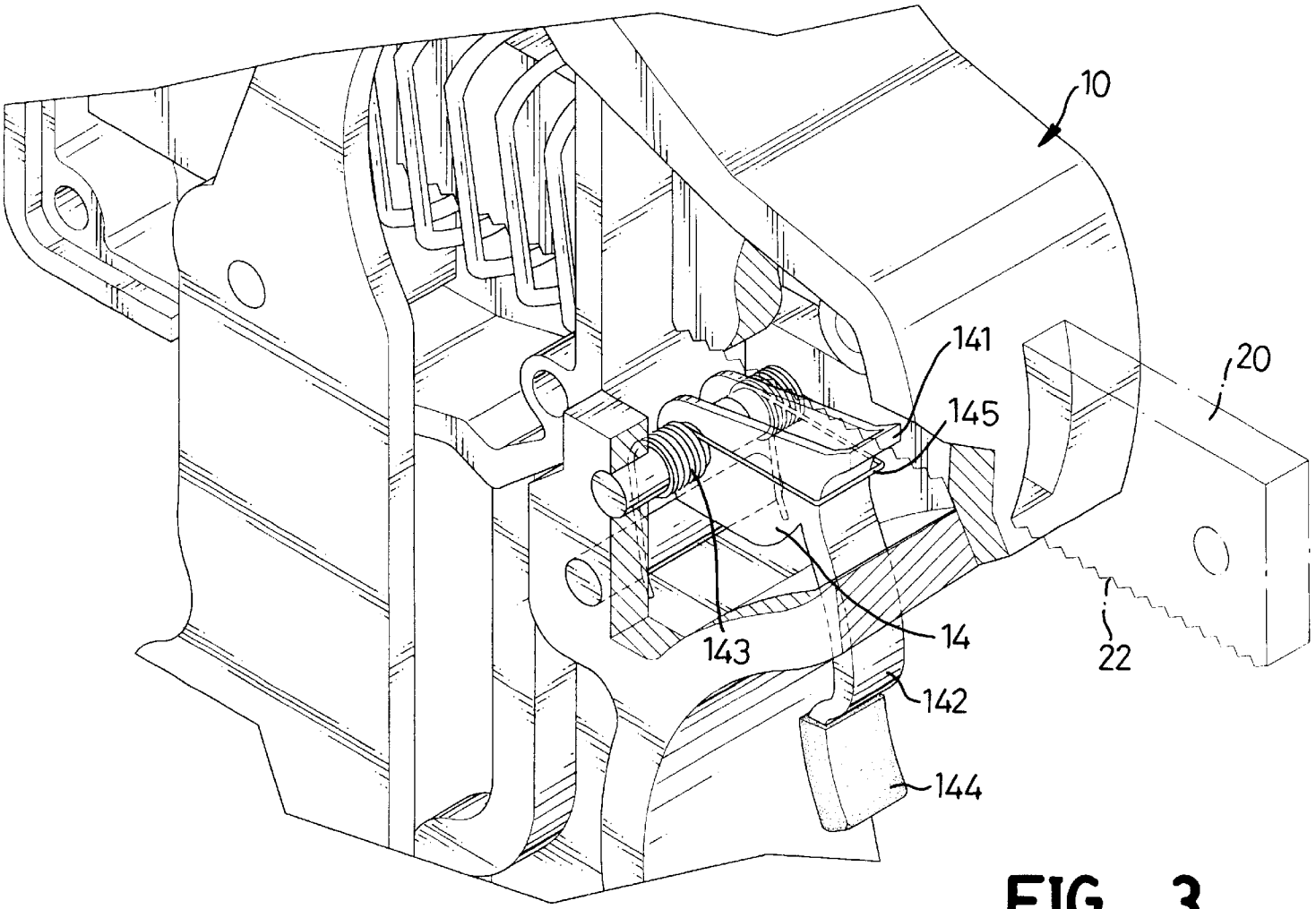
FIG. 3 is an enlarged perspective view in section showing the pawl assembly of the invention in FIG. 1 in detail.

With reference to FIG. 3, the pawl assembly (14) comprises a pawl (141), a release tab (142), a biasing element (143) and a plastic tag (144). The pawl (141) is pivotally mounted in the body (10) to engage the teeth (22) of the slide bar (20) in a standby position to keep the slide bar (20) from moving forward and releasing the clamp. The release tab (142) can be pivoted to disengage the pawl (141) from the teeth (22) of the slide bar (20). The biasing element (143) returns the pawl (141) to the standby position. The biasing element (143) is a double torsion spring that consists of a right-hand coil, a left-hand coil and a central tongue (145) connecting the coils. The right-hand coil and the left-hand coil are received in the body (10) and are co-axial with each other and are respectively mounted on two sides of the pawl (141). The tongue (145) presses against the pawl (141) so the pawl (141) is always in contact with the teeth (22) in the standby position.

Figure 4:
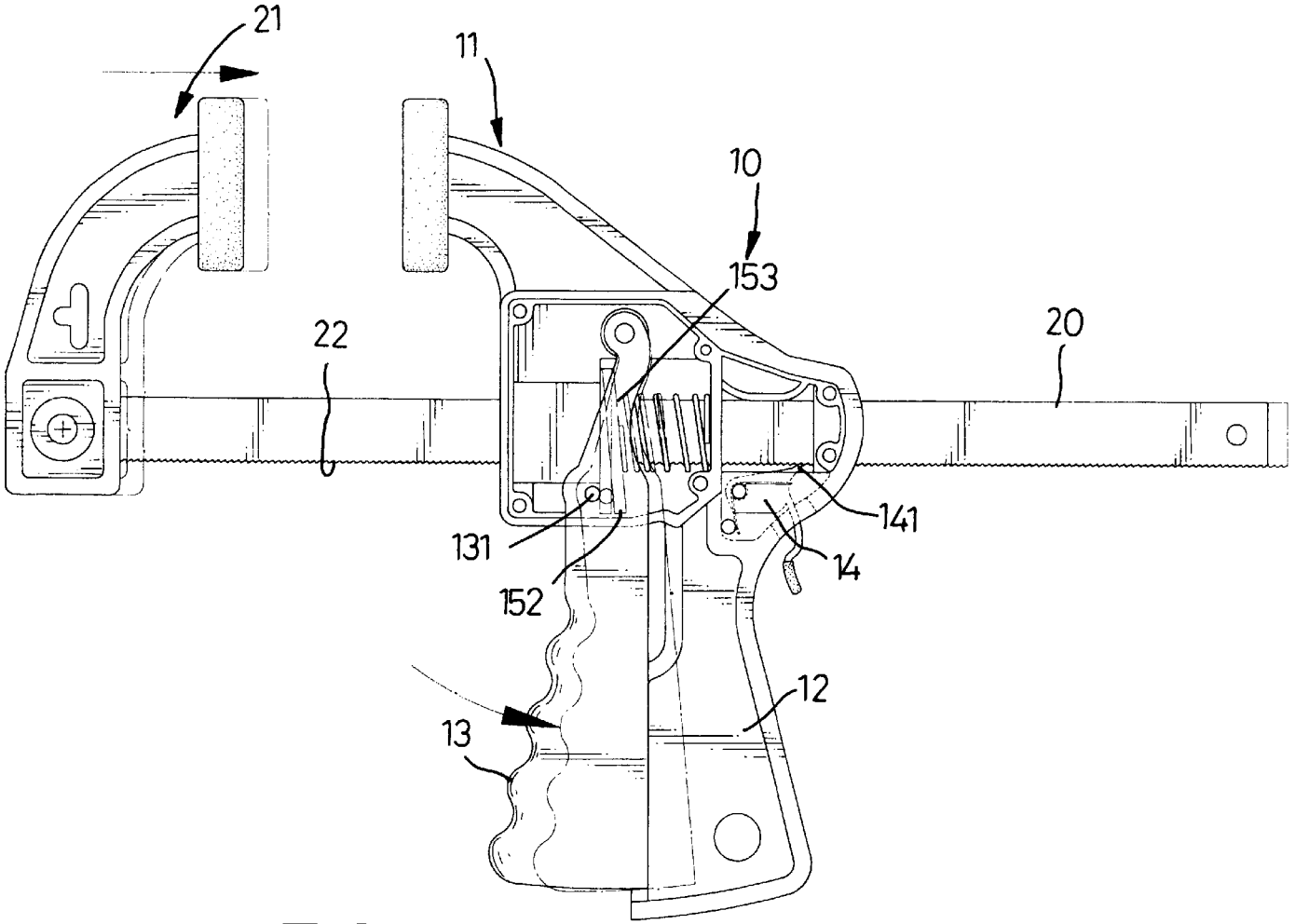
FIG. 4 is an operational plan view when the invention in FIG. 1 is clamping.

With reference to FIG. 4, when the trigger (13) is squeezed toward the handle (12), the push pin (131 ) pushes and inclines the drive lever (152) and causes the drive lever (152) to engage the teeth (22) on the slide bar (20). Further squeezing of the trigger (13) presses the drive lever (152) back which moves the slide bar (20) back and drives the movable jaw (21) toward the stationary jaw (11). At the same time, the spring (151) is compressed and generates a restitution force in the spring (151), which is applied to the drive lever (152) to return the drive lever (152) to the front edge of the central transverse opening (102) when the trigger is released.

Figure 5:
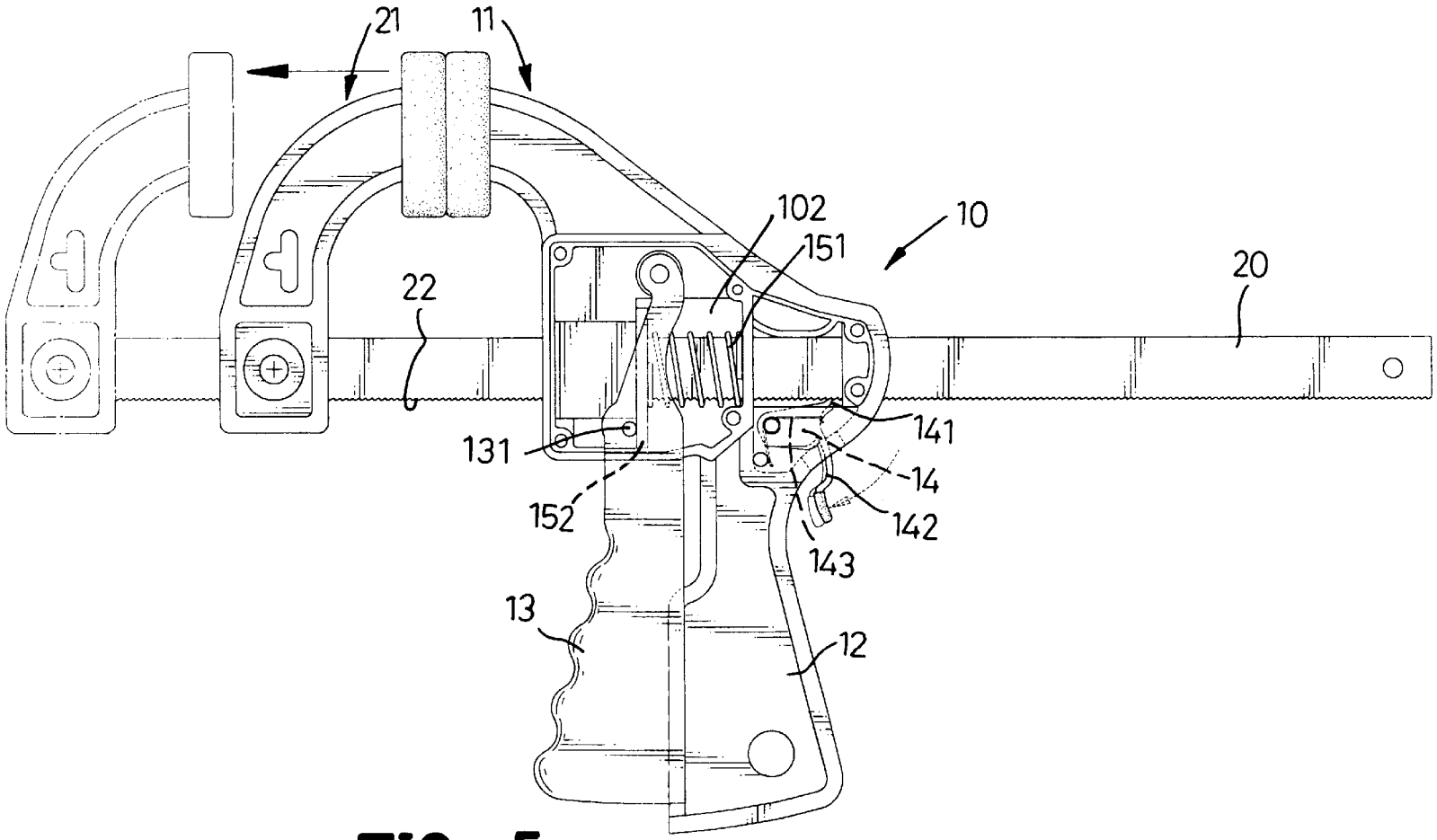
FIG. 5 is an operational plan view when the pawl of the pawl assembly dose not engage with the teeth.

With reference to FIG. 5, the movable jaw (21) can be drawn away from the stationary jaw (11) with the release tab (142) is pivoted to disengage the pawl (141) from the teeth (22) on the slide bar (20).

Figure 6:
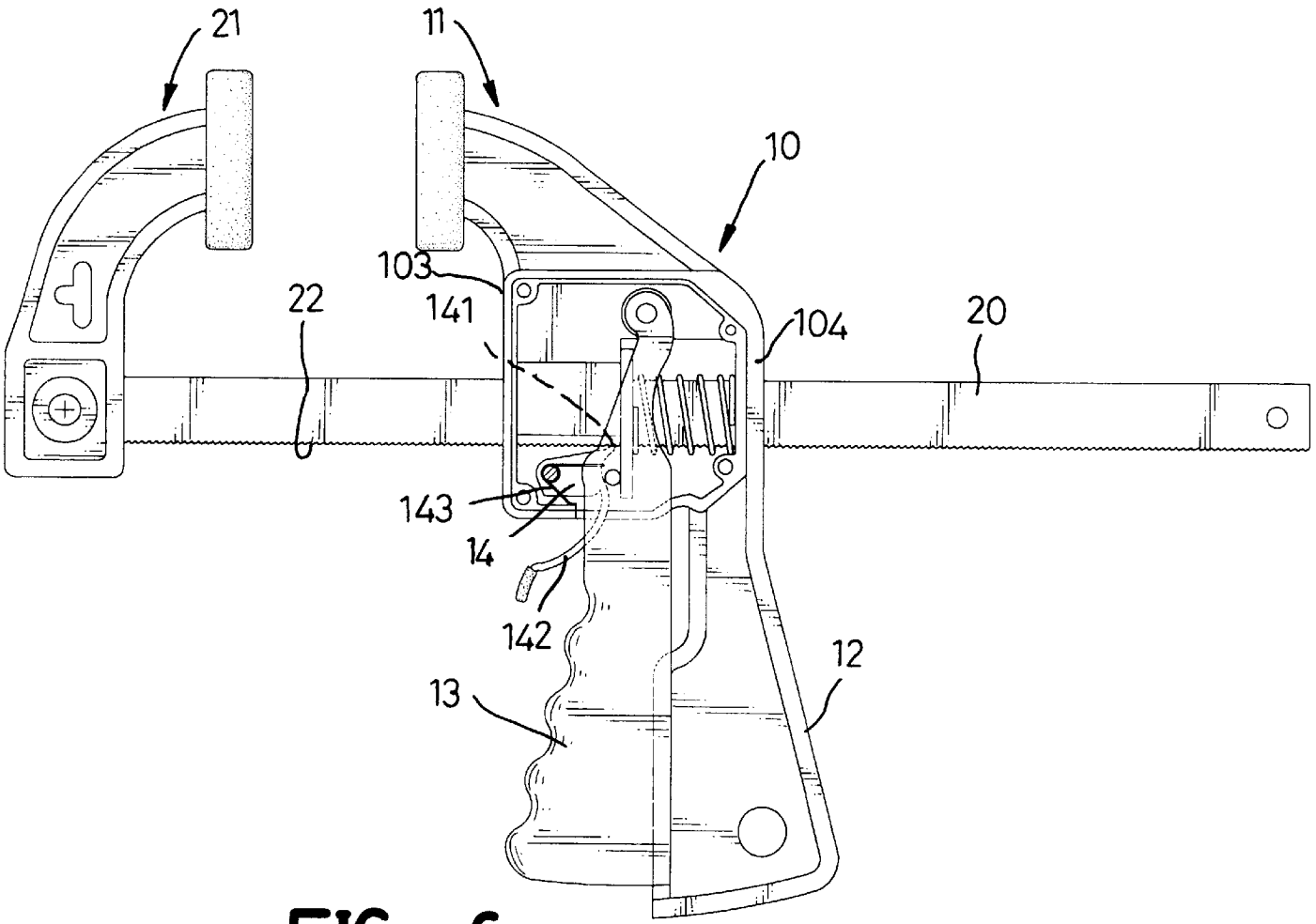
FIG. 6 is a plan view showing an alternative embodiment of the bar clamp of the invention.
Figure 7:
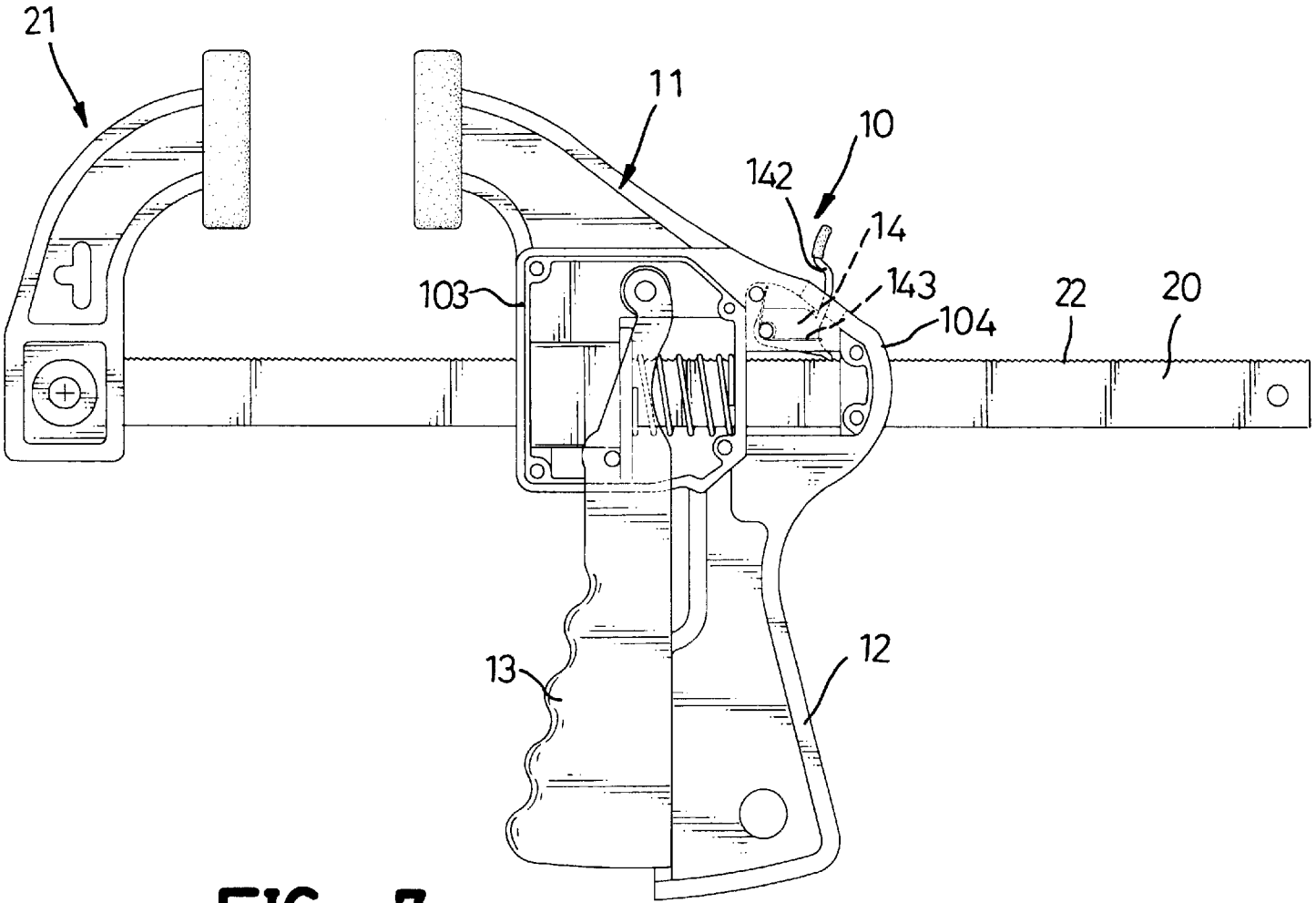
FIG. 7 is still a plan view showing another alternative embodiment of the invention.
Figure 8:
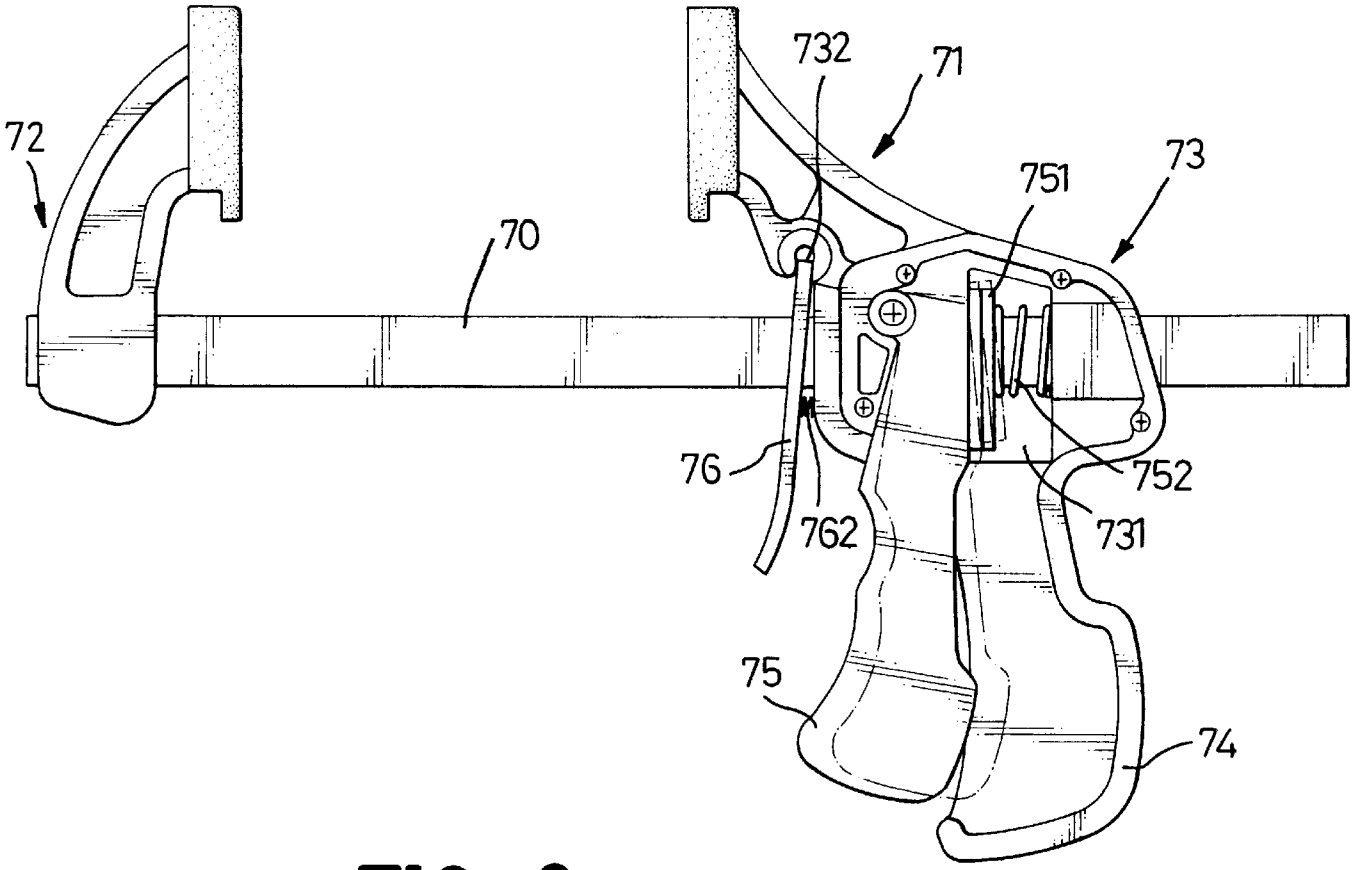
FIG. 8 PRIOR ART
FIG. 8 is a plan view showing the conventional quick-action bar clamp.

The pawl assembly (14) can be pivotally mounted in numerous suitable locations in the body (10). With reference to FIGS. 1 to 5, the pawl assembly (14) can be pivotally mounted underneath the slide bar (20) in the rear transverse opening above the handle (12) at the rear edge (104) of the body (10). With reference to FIG. 6, another embodiment of the quick-action bar clamp has the pawl assembly (14) pivotally mounted underneath the slide bar (20) near the front edge (103) of the body (10). With reference to FIG. 7, still an alternative embodiment of the quick-action bar clamp has the pawl assembly (14) pivotally mounted above the slide bar (20) with the teeth (22) on the top edge near the rear side (104) of the body (10).

The quick-action bar clamp in accordance with the present invention has the following advantages:

1. Positive engagement of the slide bar (20):

The pawl (141) and the drive lever (152) engage the teeth (22) of the slide bar (20). Therefore, the pawl (141) and the teeth (22) will positively engage the slide bar (20).

2. Easy to disengage the pawl (141) from the teeth (22):

Since the pawl (141) is held in a V-shaped notch between adjacent teeth (22) a longitudinal force between the pawl (141) and the teeth (22) holds the slide bar (20) in place. Moving the pawl (141) along the surface of the tooth (22) engaged is easy.

3. The slide bar (20) is more durable than the conventional slide bar:

The pawl (141) and the drive lever (152) do not dig into the edge of and damage the slide bar (20) but engage the teeth (22). Consequently, the slide bar (20) is durable.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A quick-action bar clamp comprising:

a body with a top, a bottom, a front edge and a rear edge, a central transverse opening with a rear edge and two sides defined through the body and a handle formed at the bottom of the body;

a non-round slide bar corresponding to the central transverse opening, having a series of teeth and slidably mounted in the body, the slide bar having a top edge, a bottom edge, a front end extending out of the front edge of the body and a rear end extending out of the rear edge of the body;

clamp device including a stationary jaw formed on the top of the body and a movable jaw opposing the stationary jaw connected to one end of the slide bar;

a drive assembly comprising:

a drive lever with a central hole mounted around the slide bar in the central transverse opening;

a trigger corresponding to the handle and pivotally attached to the body;

a push pin mounted in the trigger and adapted to push against the drive lever; and a spring mounted around the slide bar in the central transverse opening between the drive lever and the rear edge of the central transverse opening; and a pawl assembly pivotally mounted in the body with a pivot to engage the teeth on the slide bar and the pawl assembly comprising:

a pawl pivotally attached to the body and adapted to engage with one of the teeth on the slide bar in a standby position to keep the slide bar from moving while the trigger is released;

a release tab formed on the pawl to disengage the pawl from the teeth on the slide bar while the release tab is pushed; and a biasing element mounted in the body and adapted to hold the pawl in contact with the teeth in the standby position.

2. The quick-action bar clamp as claimed in claim 1, wherein the biasing element is a double torsion springs which consists a right-hand coil, a left-hand coil and a central tongue connects the coils together, and the tongue holds the pawl of the pawl assembly, wherein the right-hand coil and the left-hand coil are received in the body and are co-axial with each other; and the right-hand coil and the left-hand coil are respectively mounted on two sides of the pawl.

3. The quick-action bar clamp as claimed in claim 1, wherein the series of teeth are formed on the bottom edge of the slide bar, and the body further has a rear transverse opening; and the pawl assembly is pivotally mounted in the rear transverse opening underneath the slide bar at the rear edge of the body.

4. The quick-action bar clamp as claimed in claim 1, wherein the series of teeth are formed on the top edge of the slide bar, and the body further has a rear transverse opening; and the pawl assembly is pivotally mounted in the rear transverse opening above the slide bar at the rear edge of the body.

5. The quick-action bar clamp as claimed in claim 1, wherein the series of teeth are formed on the bottom edge of the slide bar, and the pawl assembly is pivotally mounted in the body underneath the slide bar at the front edge of the body.

6. The quick-action bar clamp as claimed in claim 3, wherein the body further has two covers and several joint holes defined around each side of the central transverse opening;

each cover has studs respectively corresponding to the joint holes in a corresponding side of the central transverse opening so that the covers are mounted on two sides of the central transverse opening respectively to cover the central transverse opening and the rear transverse opening; and one of the covers has a recess in which a label is attached.

7. The quick-action bar clamp as claimed in claim 4, wherein the body further has two covers and several joint holes defined around each side of the central transverse opening;

each cover has studs respectively corresponding to the joint holes in a corresponding side of the central transverse opening so that the covers are mounted on two sides of the central transverse opening respectively to cover the central transverse opening and the rear transverse opening; and one of the covers has a recess in which a label is attached.

8. The quick-action bar clamp as claimed in claim 5, wherein the body further has two covers and several joint holes defined around each side of the central transverse opening;

each cover has studs respectively corresponding to the joint holes in a corresponding side of the central transverse opening so that the covers are mounted on two sides of the central transverse opening respectively to cover the central transverse opening and the rear transverse opening; and one of the covers has a recess in which a label is attached.

* * * * *